US006546981B2

(12) United States Patent
Cameron

(10) Patent No.: US 6,546,981 B2
(45) Date of Patent: Apr. 15, 2003

(54) HEAD COVER WITH DIVOT REPAIR TOOL

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/902,370

(22) Filed: Jul. 10, 2001

(65) Prior Publication Data

US 2003/0010416 A1 Jan. 16, 2003

(51) Int. Cl.[7] ..... A63B 57/00

(52) U.S. Cl. ..... 150/160; 206/315.2; 473/286; 473/408

(58) Field of Search ..... 150/160; 206/315.2; 473/286, 408

(56) References Cited

U.S. PATENT DOCUMENTS

| | | | | | |
|---|---|---|---|---|---|
| 2,925,840 | A | * | 2/1960 | Hird | 150/160 X |
| 3,185,483 | A | * | 5/1965 | Klynman | 473/408 |
| 3,349,422 | A | * | 10/1967 | Heil | 15/160 |
| 3,861,434 | A | * | 1/1975 | Harding | 150/160 |
| 3,938,570 | A | * | 2/1976 | Stewart | 150/160 |
| 4,898,222 | A | | 2/1990 | Gaffney | 150/160 |
| 5,094,283 | A | * | 3/1992 | Lawrence | 150/160 |
| 5,143,371 | A | * | 9/1992 | Strahan | 473/408 |
| 5,394,914 | A | * | 3/1995 | Meek | 150/160 |
| 5,690,559 | A | * | 11/1997 | Julius | 473/286 |
| 5,997,411 | A | * | 12/1999 | Holub | 273/282 |
| 6,033,322 | A | * | 3/2000 | England | 473/408 |
| 6,138,727 | A | | 10/2000 | Shih | 150/160 |

* cited by examiner

*Primary Examiner*—Sue A. Weaver

(57) ABSTRACT

A putter cover and removably attached divot repair tool comprising a putter cover body having at least an inner surface and an outer surface where the outer surface includes two spaced apart slits. The slits have a width that is substantially similar to a tool width of the divot repair tool and the slits are spaced apart by a spaced distance that is less than a length of the divot repair tool.

7 Claims, 2 Drawing Sheets

HEAD COVER WITH DIVOT REPAIR TOOL

BACKGROUND

Golfers typically carry a set clubs in a golf bag with the club handles inserted into the bag. This causes the heads to extend out of the open end of the bag, and when the bags are moved from place to place, the heads repeatedly strike and batter each other. This also occurs when clubs are removed and inserted into the bag. "Sock" types of golf club covers have been constructed particularly for protecting the woods. These socks generally have an elastic neck on them to hold them in place over the wood when it is in the bag. They are readily and easily removed from the woods. In some cases, a draw string type of fastener is employed to secure the cover over the head and to prevent it from being accidentally dislodged. However, most head covers are now independent from each other.

A protective cover for putters, in particular, is desirable since these are the shortest clubs in the bag and are repeatedly struck and battered. Moreover, putters are often very expensive and have very elaborate finishes. In addition, some golf putters have heads made of soft steel, brass or other material that is readily scratched, dented and scuffed. Thus, protection for putters is highly desirable.

SUMMARY OF THE INVENTION

This invention is directed to an improved golf club cover with a detachable divot repair tool. All golfers should carry a divot repair tool so that they can repair ball marks on the greens. However, it is often a distraction to carry the repair tool in your pocket. The present invention provides a golfer a convenient method of carrying a divot repair tool with the putter when going to the green where the divot repair tool is needed.

In accordance with a preferred embodiment of this invention, a golf club cover has a body portion that is L-shaped or longitudinal to cover the head of a putter. Located on the outer surface of the body is means for attaching a divot repair tool. In a preferred embodiment, the outer surface of the cover body includes a plurality of slits such that a first slit can receive a first end of a divot repair tool and a second slit can receive a second end of the divot repair tool. In another embodiment, the outer surface of the cover body includes a first portion of a hook and loop fastener and the divot repair tool has a second portion of a hook and loop fastener such that the divot repair tool can be readily attached to the outer surface.

DETAILED DESCRIPTION

Figure 1:
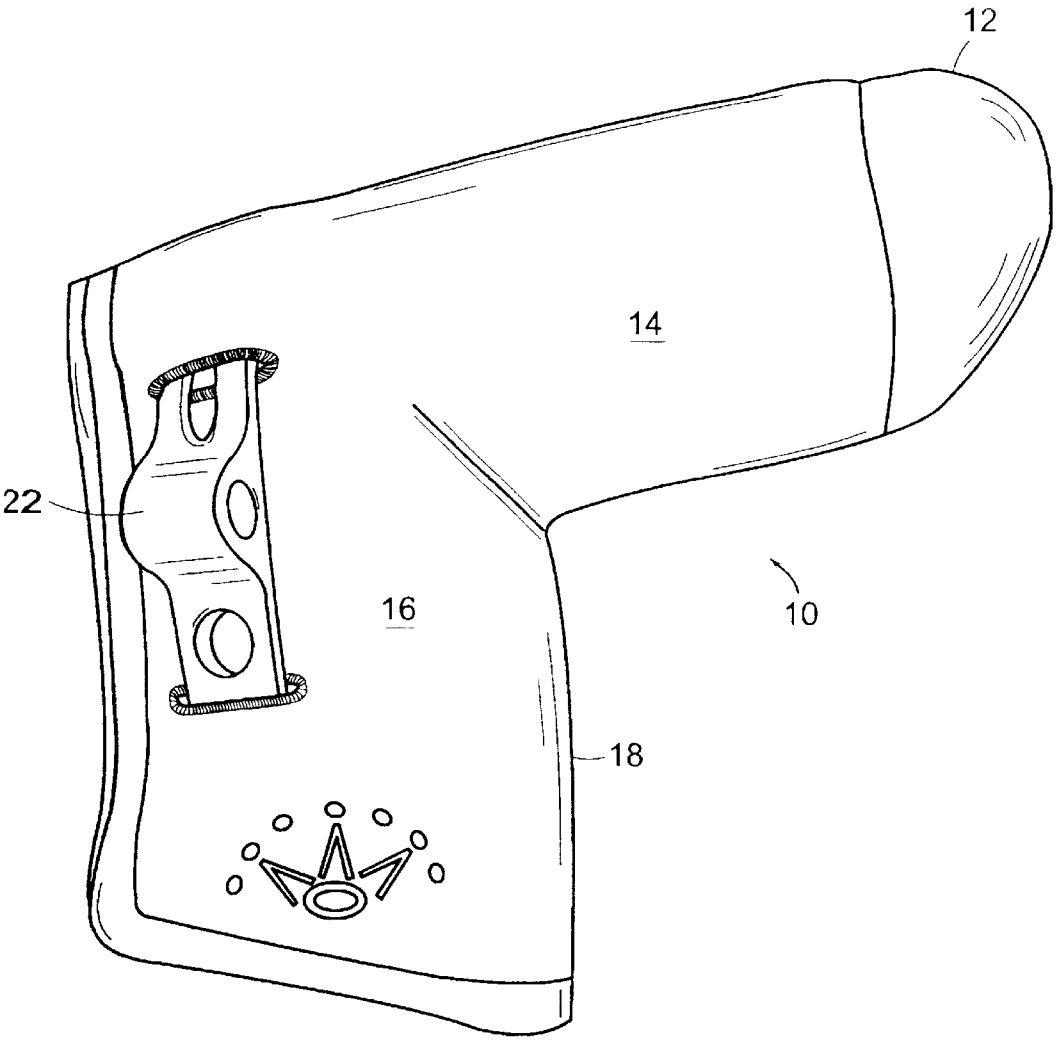
FIG. 1 is a perspective view of a preferred embodiment of the invention illustrating its use.

Referring now to the drawings, the same reference numbers are used throughout the different figures to designate the same components. FIG. 1 shows a head cover 10 in accordance with a preferred embodiment of the invention. This head cover 10 preferably is made of a single sheet of laminated materials cut in a blank in a generally "T" shaped configuration. The materials are then folded to form a generally "L-shaped" cover and it is sewn together along the edge at the seam 12.

The resultant cover has a main body portion 14 that has an internal cavity large enough to fit over the heads of putters of different sizes. This cavity has a second shaft encircling portion 16 integrally attached to it. The shaft portion 16 extends generally parallel to the shaft of a golf club inserted into the cover. Also, the overall configuration of the device is generally "L-shaped".

On the outer surface 18 of the head cover 10 is a divot repair tool attachment 20 that permits the divot repair tool 22 to be attached to the head cover 10. In the preferred embodiment, the attachment 20 is comprised of a plurality of apertures or slits 24 and 26. As shown, the divot repair tool 22 is inserted into the apertures 24 and 26 so that it is removably attached to the head cover 10. Most preferably, the apertures 24 and 26 are approximately the same width W and are spaced from each other by a distance D that is less than a length L of the divot repair tool 22. Preferably, the apertures are spaced a distance D of between about 40 and 90% of the length L of the divot repair tool. More preferably, the apertures are spaced a distance D of about 50% of the length L of the divot repair tool and have a width W that is approximately the same as the width W2 of the divot repair tool.

Figure 2:
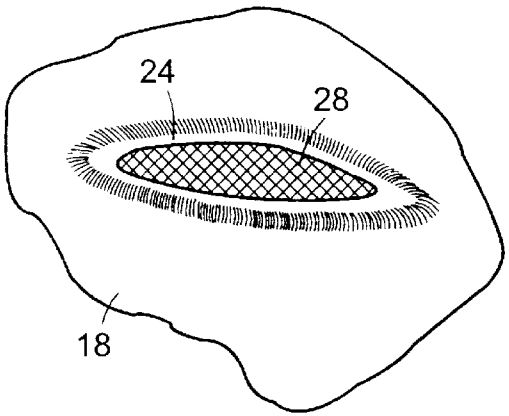
FIG. 2 is a partial, blown-up view of the head cover of FIG. 1.

As shown in FIG. 2, the cover 10 further includes at least one inner layer 28 inside of the outer surface 18 that prohibits the divot repair tool from abutting the putter.

More preferably, the cover includes a soft innermost layer (not shown) for abutting the putter head and tear resistant, mesh inner layer to prevent the divot repair tool from abutting and scratching the putter head. Most preferably, the inner layer 28 is comprised of a thermoplastic mesh and the outer surface 18 of leather or synthetic leather.

Figure 3:
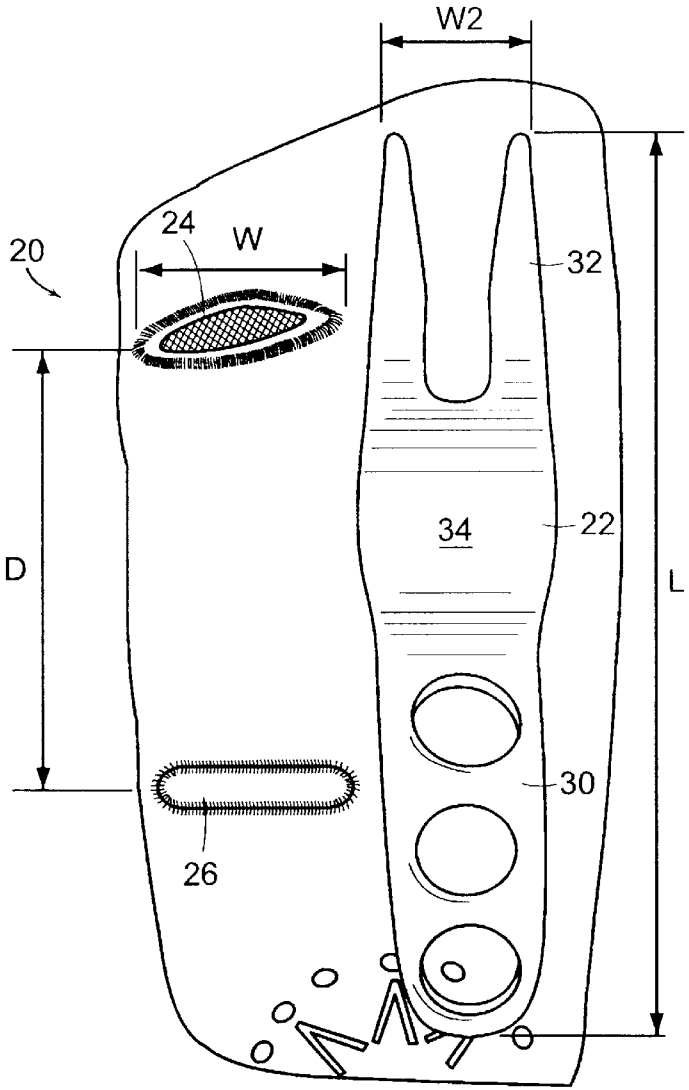
FIG. 3 is a partial, blown-up view of the head cover and divot repair tool.

The view of FIG. 3 illustrates the manner in which the divot repair tool is attached to the head cover 10. The handle portion 30 of the tool 22 is longer than the repair portion 32. Also, the tool 22 has a pivot portion 34 between the handle portion 30 and the repair portion 32. As stated above, the distance D between the slits 24 and 26 is less than the length L of the tool 22. With this construction, the tool handle portion 30 can be inserted into the lower slit 26 and pushed down until the pivot portion 34 abuts the slit. Preferably, the slit 26 is dimensioned such that the pivot portion 34 cannot be inserted into the slit 26. Then the repair portion 32 can be inserted into the upper slit 24 and the tool 22 is held in place.

Figure 4:
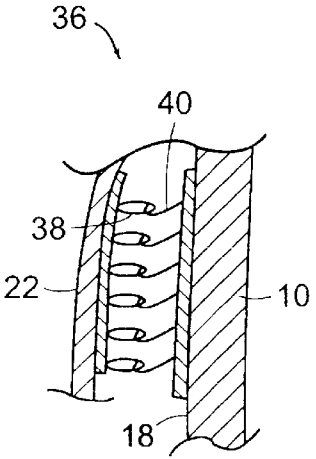
FIG. 4 is a partial, blown-up, cross-sectional view of the head cover and divot repair tool of a second embodiment.

FIG. 4 illustrates a second type of attachment 36 where the tool 22 includes a first portion of a hook and loop fastener 38 and the head cover 10 includes a second portion of a hook and loop fastener 40. Thus, the tool can easily be attached and detached to the head cover 10. Other fasteners, such as snaps and magnets could also be used in this manner.

The foregoing description of the preferred embodiments of the invention is to be considered illustrative of the invention and not as limiting. Various changes and modifications will occur to those skilled in the art without departing from the true scope of the invention. Fasteners other than slits and hook and loop fabric fasteners may be used, if desired, to accomplish the same purpose. Multi-layer material or padding may also be employed. The relative dimensions which have been described may be varied for particular applications also without departing from the true scope of the invention as defined in the appended claims.

I claim:

1. A golf club cover and a detachable divot repair tool comprising: a cover body with an attachment member for detachably receiving the divot repair tool, wherein the attachment member comprises a plurality of apertures in an outer surface of the cover for receiving the divot repair tool.

2. The golf club cover and divot repair tool of claim 1, wherein the plurality of apertures for receiving the divot repair tool are approximately the same width and are spaced from each other by a distance that is less than a length of the divot repair tool.

3. The golf club cover and divot repair tool of claim 2, wherein the spaced distance is between about 40 and 90% of the length of the divot repair tool.

4. The golf club cover and divot repair tool of claim 1, wherein the cover is substantially L-shaped and the body comprises a first portion thereof for covering a head portion of the putter and a second portion of the cover extends from the body at an angle thereto for covering a shaft portion of the putter.

5. The golf club cover and divot repair tool of claim 4, wherein the cover further includes at least one inner layer inside of the outer surface that prohibits the divot repair tool from abutting the putter.

6. A putter cover and divot repair tool comprising:

a putter cover body having at least an inner surface and an outer surface, the outer surface including two spaced apart slits, the slits having a width that is substantially similar to a tool width of the divot repair tool and the slits being spaced apart by a distance that is less than a length of the divot repair tool.

7. The golf club cover and divot repair tool of claim 6, wherein the distance is between about 40 and 90% of the length of the divot repair tool.

* * * * *